US006546957B2

(12) United States Patent
Hajek, Jr.

(10) Patent No.: US 6,546,957 B2
(45) Date of Patent: Apr. 15, 2003

(54) DUAL CYLINDER CIRCUIT HAVING A JOYSTICK WITH INTUITIVE CONTROL

(75) Inventor: Thomas J. Hajek, Jr., Lockport, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/740,458

(22) Filed: Dec. 19, 2000

(65) Prior Publication Data

US 2002/0074045 A1 Jun. 20, 2002

(51) Int. Cl.[7] ..... F15B 13/06
(52) U.S. Cl. ..... 137/596.14; 91/523; 137/636.2
(58) Field of Search ..... 91/523, 471; 137/596.14, 137/636.2

(56) References Cited

U.S. PATENT DOCUMENTS

| | | | | |
|---|---|---|---|---|
| 3,183,929 A | | 5/1965 | Weaver | |
| 4,285,546 A | | 8/1981 | Etherington | |
| 5,063,739 A | | 11/1991 | Bianchetta et al. | |
| 5,283,401 A | | 2/1994 | Schumucker | |
| 5,491,462 A | | 2/1996 | Cecdhi et al. | |
| 5,589,828 A | | 12/1996 | Armstrong | |
| 5,610,631 A | | 3/1997 | Bouton et al. | |
| 5,786,997 A | | 7/1998 | Hoyt et al. | |
| 5,868,230 A | * | 2/1999 | Chatterjea et al. | 137/636.2 X |
| 5,875,631 A | | 3/1999 | Smith | |
| 5,969,520 A | | 10/1999 | Schottler | |
| 6,002,351 A | | 12/1999 | Takeda et al. | |
| 6,017,273 A | | 1/2000 | Pelkey | |

* cited by examiner

*Primary Examiner*—Gerald A. Michalsky
(74) *Attorney, Agent, or Firm*—Howard & Howard; Steve M Hanley

(57) ABSTRACT

A joystick controller is provided in a hydraulic circuit having a pair of hydraulic actuators and oriented with respect to the operator so that movement of a control lever of the joystick controller relative to a reference axis oriented perpendicular to the operator results in control signals being generated and delivered to the first and second main control valves so that the respective cylinders are moved in a direction that is intuitive to the operator. For example, forward movement of the control lever results in both hydraulic actuators moving in the same forward or downward direction and movement of the control lever rearwardly results in both actuators moving in the rearward or upward direction. Likewise, movement of the control lever along an axis that is oriented forty five degrees from the reference axis results in control of one of the actuators independent of the other one.

10 Claims, 2 Drawing Sheets

DUAL CYLINDER CIRCUIT HAVING A JOYSTICK WITH INTUITIVE CONTROL

TECHNICAL FIELD

This invention relates to a hydraulic circuit having dual cylinders and more particularly to a hydraulic circuit wherein the dual cylinders are controlled with a single joystick that is movable in a manner that is intuitive to the operator.

BACKGROUND ART

Many machines have work elements that are controlled by a single joystick controller. Likewise, several machines have work elements wherein the up and down movement thereof is controlled by independent dual hydraulic cylinders. The joystick controllers may produce electrical signals to control a main control valve or may result in the actuation of hydraulic pilot valves which in turn hydraulically operate a main control valve. In current joystick controllers, the directional movement of the single joystick's motion does not correspond to the independent directional movement of the respective right and left cylinders. A typical pilot control arrangement is illustrated U.S. Pat. No. 5,063,739 issued Nov. 12, 1991 to Caterpillar Inc. and illustrates pilot controls 23,24 that could be one integral joystick controller. It is desirable for the operator to move the joystick lever in a direction that would intuitively result in the left and right hydraulic cylinders moving in a corresponding direction. For example, if the operator moves the joystick control lever forward, the operator would want the implement to move down and if the operator moves the lever rearward, the operator would want the implement to move up. Additionally, the operator would also want to move each cylinder independently so that the implement can be oriented in various positions. With the past joystick controllers, the movement of the implement does not correspond to the instinctive or intuitive movement of the operator.

Accordingly, the present invention is directed to overcoming one or more of the problems as set forth above.

DISCLOSURE OF THE INVENTION

In one aspect of the present invention, a hydraulic circuit is provided to intuitively control the movement of first and second hydraulic actuators. The hydraulic circuit includes a source of pressurized fluid, a reservoir, a first main control valve connected between the source of pressurized fluid and the first hydraulic actuator, and a second main control valve connected between the source of pressurized fluid and the second hydraulic actuator. A joystick controller having a control lever is provided in the circuit and is connected to the first and second main control valves. The joystick controller is operative to actuate the respective first and second main control valves in response to movement of the control lever of the joystick controller. The control lever is movable through a full circular pattern to actuate the respective first and second main control valves. A reference axis is defined in the joystick controller and oriented at a perpendicular position relative to the operator. Movement of the control lever along a path forty-five degrees of the reference axis results in a single control signal being directed to one end of one of the respective first and second main control valves. Movement of the control lever in a path less than forty five degrees results in two separate signals being directed to opposite ends of one of the first and second main control valves. Movement of the control lever along a path greater than forty five degrees results in two separate signals being directed to corresponding ends of each of the first and second main control valves.

In another aspect of the present invention, a method provides intuitive movement of a pair of hydraulic cylinders in a hydraulic circuit by operator movement of a control lever of a joystick controller having a reference axis and is operative to control actuation of first and second main control valves. The method includes the steps of orienting the reference axis perpendicular to the position of the operator, generating a single control signal from the joystick controller in response to movement of the control lever along a path oriented at forty five degrees relative to the reference axis, generating two separate control signals from the joystick controller and directing the respective signals to corresponding ends of each of the first and second main control valves in response to the control lever being moved in a path greater than forty five degrees of the reference axis, and generating two separate control signals from the joystick controller and directing the respective signals to opposite ends of one of the first and second control valves in response to the control lever being moved in a path less than forty five degrees of the reference axis.

BEST MODE FOR CARRYING OUT THE INVENTION

Figure 1:
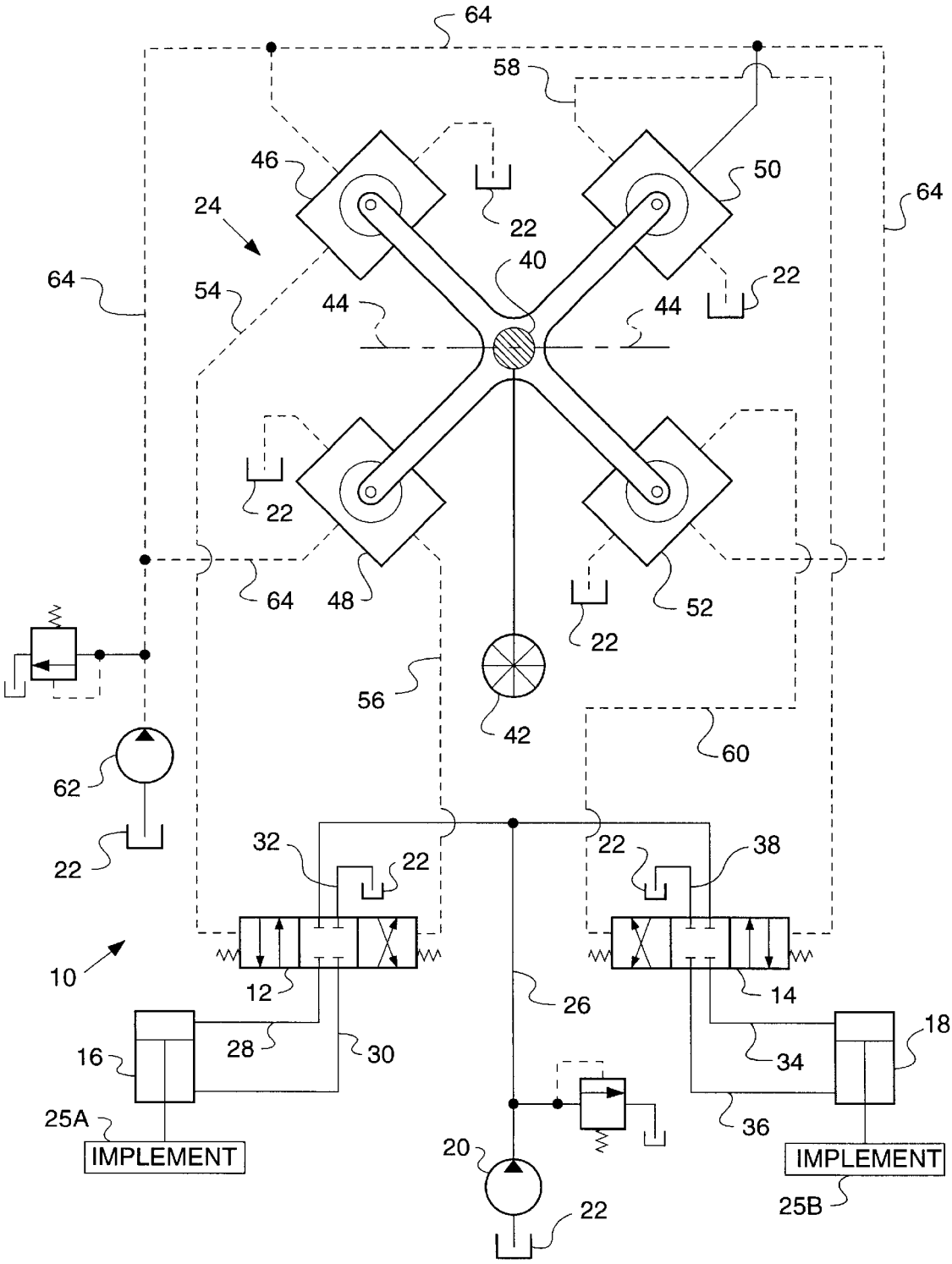
FIG. 1 is a partial diagrammatic and a partial schematic representation of a hydraulic circuit having a joystick controller and incorporating an embodiment of the present invention.
Figure 2:
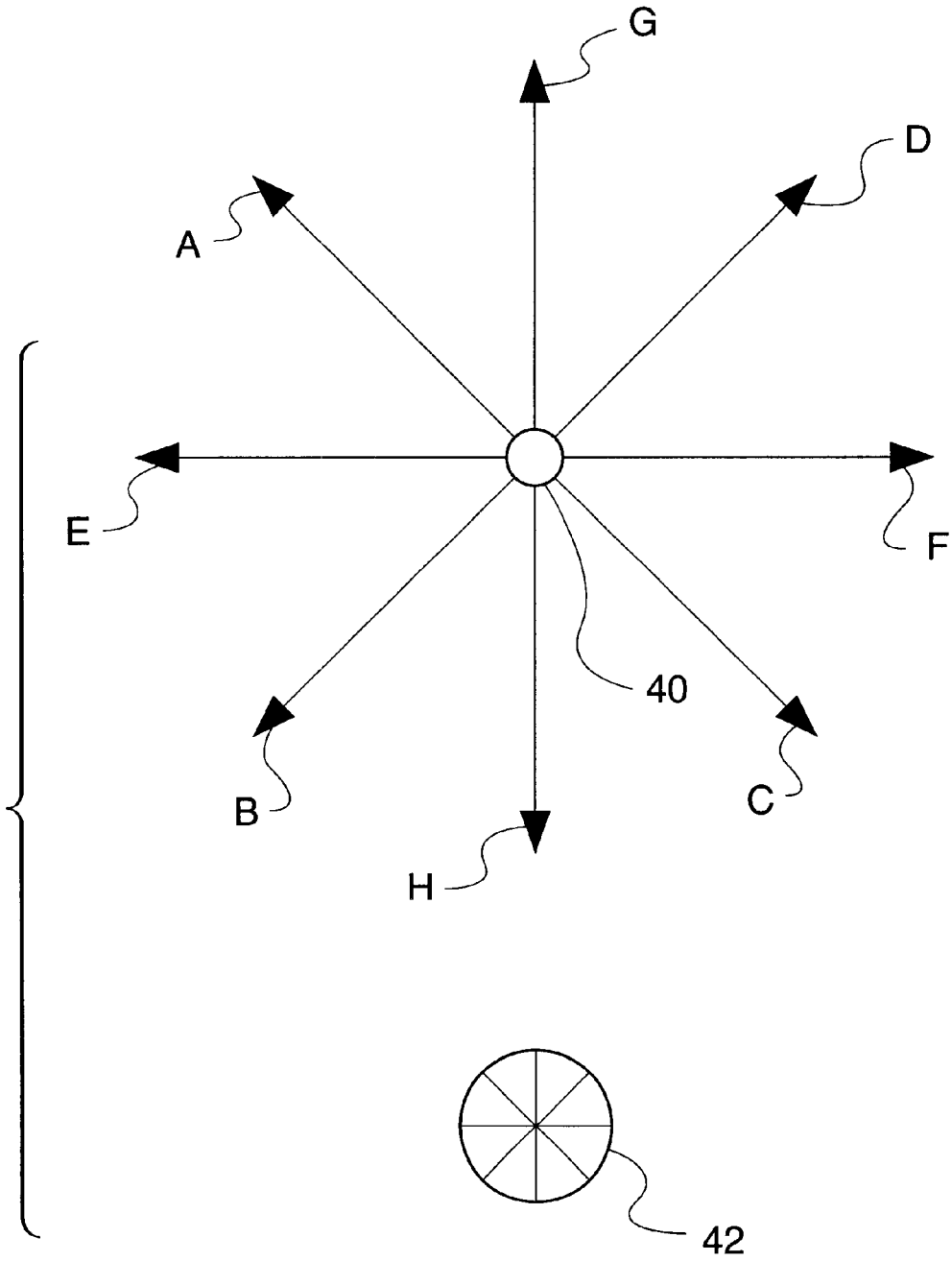
FIG. 2 is a diagrammatic representation of various paths of movements of the joystick controller of FIG. 1.

Referring to FIGS. 1 and 2, a hydraulic circuit 10 is illustrated and includes first and second main control valve 12,14, first and second hydraulic actuators 16,18, a source of pressurized fluid 20, a reservoir 22, and a joy stick controller 24. An implement 25A, such as, for example, a first stabilizer arm, is connected to the first hydraulic actuator 16 and an implement 25B, such as, for example, a second stabilizer arm, is connected to the second hydraulic actuator 18. It is recognized that a single implement, such as, for example, a ground working blade, could be connected to both of the first and second hydraulic actuators 16,18. The first main control valve 12 is operatively connected by a conduit 26 to the source of pressurized fluid 20, by conduits 28,30 to the first hydraulic actuator 16, and to the reservoir 22 by conduit 32. The second main control valve 14 is operatively connected by the conduit 26 to the source of pressurized fluid 20, by conduits 34,36 to the second hydraulic actuator 18, and to the reservoir 22 by conduit 38.

The joystick controller 24 has a control lever 40 that is movably controlled by an operator 42 spaced from the joystick controller 24 and defines a reference axis 44 that extends through the control lever 40 and is oriented perpendicular to the operator 42. The control lever 40 is movable within a full 360 degrees pattern as is well known in the art.

In the subject arrangement, the joystick controller 24 is a hydro-mechanical controller wherein movement of the control lever 40 within its 360 degrees of travel pattern mechanically actuates respective first, second, third, and fourth pilot valves 46,48,50,52. Actuation of each of the respective pilot valves 46,48,50,52 generates and delivers respective first, second, third, and fourth control signals 54,56,58,60 through the respective signal lines. The first control signal 54 is delivered to one end of the first main control valve 12 and the second control signal 56 is delivered to the other end of the first main control valve 12. The third control signal 58 is delivered to one end of the second main control valve 14 and the fourth control signal 60 is delivered to the other end of the second main control valve 14.

A source of pressurized pilot fluid 62 delivers pressurized pilot fluid to each of the first, second, third, and fourth pilot valves through pilot line 64. It is recognized that the joystick controller 24 could be an electronic joystick controller that delivers electrical signals therefrom to actuate solenoid pilot valves located remote from the joystick controller or the joystick controller could generate electrical signals and deliver the electrical signals directly to each of the main control valves to electrically actuate them.

Referring specifically to the structure of the subject arrangement and as viewed in FIG. 1, the first pilot valve 46 is located and actuated at a position oriented 45 degrees above the reference axis 44 and the angle has an apex defined by the control lever 40. The second pilot valve 48 is located and actuated at a position oriented 45 degrees below the reference axis 44 and the angle has an apex defined by the control lever 40. The third pilot valve 50 is spaced from each of the first and second pilot valves 46,48 and located and actuated at a position oriented 45 degrees above the reference axis 44 and the angle has an apex defined by the control lever 40. The fourth pilot valve 52 is spaced from each of the first, second and third pilot valves 46,48,50 and located and actuated at a position oriented 45 degrees below the reference axis 44 and the angle has an apex defined by the control lever 40. Each of the pilot valves 46,48,50,52 are spaced from and actuated by the control lever 40 at substantially the same distance from the apex.

Referring to FIG. 2, movement of the control lever 40 in the direction of arrow 'A' actuates the first pilot valve 46 to generate the first control signal 54. Movement of the control lever 40 in the direction of arrow 'B' actuates the second pilot valve 48 to generate the second control signal 56. Movement of the control lever 40 in the direction of arrow 'C.' actuates the third pilot valve 50 to generate the third control signal 58. Movement of the control lever 40 in the direction of arrow 'D' actuates the fourth pilot valve 52 to generate the fourth control signal 60. Movement of the control lever 40 in the direction of 'E' actuates both of the first and second pilot valves 46,48 an equal amount to deliver equal first and second control signals 54,56 to each end of the first main control valve 12. Movement of the control lever 40 in the direction of arrow 'F' actuates both of the third and fourth pilot valves 50,52 an equal amount to deliver equal third and fourth control signals 58,60 to each end of the second main control valve 14. Movement of the control lever 40 in the direction of arrow 'G' actuates both of the first and third pilot valves 46,50 an equal amount to deliver equal first and third control signals 54,58 to the one end of each of the first and second main control valves 12,14. Movement of the control lever 40 in the direction of arrow 'H' actuates both of the second and fourth pilot valves 48,52 an equal amount to deliver equal second and fourth control signals 56,60 to the other ends of the respective first and second main control valves 12,14. Any movement of the control lever 40 between any of the arrows 'A,B,C,D,E,F, G,H' results in varied signals being delivered to the appropriate ends of the first and second main control valves 12,14 depending on the position of the control lever 40.

It is recognized that the connection of the first control signal 54 to the first main control valve 12 could be interchanged with the fourth control signal 60 to the second main control valve 14 and that the second control signal 56 to the first main control valve 12 could be interchanged with the third control signal 58 to the second main control valve 14 without departing from the essence of the subject invention. This exchange or reversal of control signal lines permits the control to also be intuitive of the operator's reactionary movements relative to the machine. For example, with the operator holding onto the control lever 40, if the machine encounters a bump or for some other reason the machine suddenly lunges forward, the rearward movement of the operator counteracts the motion of the implement movement to basically nullify the sudden change of the machine movement. Likewise, if the operator is moved to the left or right due to sudden machine movement, the left or right movement of the operator counteracts the movement of the associated implement.

INDUSTRIAL APPLICABILITY

During operation of the subject hydraulic circuit, the operator moves the control lever 40 to raise or lower the respective implements 25A,25B attached to the first and second hydraulic actuators 16,18. By moving the control lever in the 'H' direction, both of the implements 25A,25B, as viewed in the drawing of FIG. 1, are raised, as viewed in the drawing, at the same rate. This is true since the second and fourth control signals 56,60 being delivered to the other end of each of the first and second main control valves 12,14 are of equal magnitude. Likewise, if the operator moves the control lever 40 in the direction of arrow 'G', both of the implements 25A,25B are moved down at the same rate since both of the first and third control signals 54,58 are of equal magnitude. Movement of the control lever 40 in either direction in a path away from the respective arrows 'G,H' results in the first and second implements 25A,25B being lowered or raised at different rates depending on the position of the control lever 40.

Movement by the operator of the control lever 40 in the direction of arrow 'E' results in first and second control signals 54,56 of equal magnitude being delivered to opposed ends of the first main control valve 12. Since the magnitude of the signals are equal, the first main control valve 12 remains in the closed, center position. Any movement of the control lever 40 away from the path of the arrow 'E' results in incremental, finely controlled, movement of the first main control valve 12 thus providing very fine control of movement of the first implement 25A. This happens as a result of the pressure acting on one end of the main control valve 12 is smaller than the pressure acting on the other end and the differential pressure therefrom controls movement of the main control valve 12. Likewise, movement of the control lever 40 along the path of the arrow 'F' delivers third and fourth control signals 58,60 to opposed ends of the second main control valve 14 thus holding the second main control valve 14 in its closed, center position. Any movement of the control lever 40 away from the path of the arrow 'F' provides very fine control of the second implement 25B.

In view of the foregoing, it is readily apparent that a hydraulic circuit 10 is provided that has a joystick controller 24 that controls the movement of first and second implements 25A,25B in response to the intuitive movement of the operator. That is, movement of the control lever 40 by the operator along the arrow path 'G' lowers the implements 25A,25B, and movement of the control lever along the arrow path 'H' raises the implements 25A,25B. Likewise, movement of the control lever 40 in the leftward direction along and either side of the arrow path 'E' controls the left implement 25A while movement of the control lever 40 in the rightward direction along and either side of the arrow path 'F' controls the right implement 25B. This intuitive movement by the operator to control the respective right and left implements 25A,25B make the operator more efficient and is less confusing to operate. It is likewise apparent that the subject machine controls can be connected so that the intuitive controls is responsive to direction of movement of the control lever or responsive to counteract the movement of the operator relative to the machine.

Other aspects, objects and advantages of the present invention can be obtained from a study of the drawings, the disclosure and the appended claims.

What is claimed is:

1. A joystick apparatus to control movement of a first actuator and a second actuator in communication with an input source, the apparatus comprising, a first valve arrangement;

a second valve arrangement;

a joystick controller comprising a control member and being in selective communication with said first actuator through said first valve arrangement and being in selective communication with said second actuator through said second valve arrangement;

said joystick controller being configured to urge substantially proportional movement of said first actuator and said second actuator in a first direction in response to movement of said control member along a first path and substantially proportional movement of said first actuator and said second actuator in a second direction in response to movement of said control member along a second path, said first and second actuators being independently moveable in response to movement of said control member along paths not including said first path or said second path.

2. The joystick apparatus of claim 1, wherein selective movement of said control member along a third path is operative to incrementally move one of said first or second actuators.

3. The joystick apparatus of claim 2, wherein movement of said control member along a fourth path is operative to incrementally move the other of said one of said first or second actuators.

4. The joystick apparatus of claim 3, wherein said first and second paths of said control member are separated by about 180 degrees.

5. The joystick apparatus of claim 4, wherein said third and fourth paths of said control member are respectively separated from said first and second paths of said control member by about 45 degrees.

6. The joystick apparatus of claim 1, wherein said control member is moveable within a travel pattern, said travel pattern having first and second portions and being divided by said first and second paths, said one of said first or second actuators is exclusively controllable by selective movement of said control member within said first portion of said travel pattern and the other of said one of said first or second actuators is exclusively controllable by selective movement of said control member within said second portion of said travel pattern.

7. A joystick apparatus to control movement of a first actuator and a second actuator in communication with an input source, the apparatus comprising, a first valve arrangement;

a second valve arrangement;

a joystick controller comprising a control member and being in selective communication with said first actuator through said first valve arrangement and being in selective communication with said second actuator through said second valve arrangement; and a first pilot valve and a second pilot valve, said first pilot valve is in communication with said first valve arrangement and said second pilot valve is in communication with said second valve arrangement, said first and second pilot valves are operative to urge movement of said first and second actuators through said first and second valve arrangements, said first and second actuators being in tracking relation with said control member through said first and second pilot valves;

said joystick controller being configured to urge substantially proportional movement of said first actuator and said second actuator in a first direction in response to movement of said control member along a first path and substantially proportional movement of said first actuator and said second actuator in a second direction in response to movement of said control member along a second path, said first and second actuators being independently moveable in response to movement of said control member along paths not including said first path or said second path.

8. A hydraulic circuit to intuitively control, in response to an input, the movement of first and second hydraulic actuators, the hydraulic circuit comprising:

a source of pressurized fluid;

a reservoir;

a first main control valve connected between the source of pressurized fluid and the first hydraulic actuator;

a second main control valve connected between the source of pressurized fluid and the second hydraulic actuator;

a joystick controller having a control member and being connected to the first and second main control valves, the joystick controller being operative to actuate the respective first and second main control valves in response to movement of the control member of the joystick controller, the control member is movable through a circular pattern to actuate the respective first and second main control valves, a reference axis is defined in the joystick controller and oriented at a substantially perpendicular position relative to the input, movement of the control member along a path substantially perpendicular to the reference axis delivers two separate signals of equal magnitude to the corresponding ends each of the first and second main control valves, movement of the control member along a path of about forty-five degrees relative to the reference axis results in a single control signal being directed to one of the ends of one of the respective first and second main control valves, movement of the control member in a path less than about forty-five degrees relative to the reference axis results in two separate signals being directed to opposite ends of one of the first and second main control valves and movement of the control lever in a path greater than about forty-five degrees relative to the reference axis results in two separate signals being directed to a corresponding end of each of the first and second main control valves.

9. The hydraulic system of claim 8 wherein movement of the control member along a path corresponding to the reference axis deliver two separate signals of substantially equal magnitude to each end of one of the first and second main control valves.

10. The hydraulic system of claim 9 wherein the joystick controller includes four mechanically actuated pilot valves and each of the four mechanically actuated pilot valves are spaced from one another and oriented at an angle of about forty five degrees from the reference axis.

* * * * *